United States Patent [19]

Cummings et al.

[11] Patent Number: 4,722,579

[45] Date of Patent: Feb. 2, 1988

[54] ELECTRICAL CONNECTOR DEVICES AND METHODS

[76] Inventors: Steven Cummings, 59 W. 650 North; Keith Cummings, 481 N. 200 West, both of Heber, Utah 84032

[21] Appl. No.: 927,846

[22] Filed: Nov. 6, 1986

Related U.S. Application Data

[63] Continuation of Ser. No. 696,771, Jan. 31, 1985, abandoned.

[51] Int. Cl.[4] ..... H01R 4/24

[52] U.S. Cl. ..... 439/391; 439/439; 439/441

[58] Field of Search ..... 339/95 R, 95 D, 97 R, 339/97 P, 98, 99 R

[56] References Cited

U.S. PATENT DOCUMENTS

| | | | |
|---|---|---|---|
| Re. 26,994 | 12/1970 | Fuller et al. | 174/84 |
| 2,291,434 | 7/1942 | Hollopeter et al. | 173/324 |
| 2,333,266 | 11/1943 | Miller | 173/340 |
| 3,079,577 | 2/1963 | Brownfield | 339/17 |
| 3,139,314 | 6/1964 | Miller | 339/97 |
| 3,210,719 | 10/1965 | Graeff | 339/95 |
| 3,704,438 | 11/1972 | Boone | 339/95 D |
| 4,194,802 | 3/1980 | Spaulding | 339/97 P |

FOREIGN PATENT DOCUMENTS

| | | | |
|---|---|---|---|
| 1251400 | 10/1967 | Fed. Rep. of Germany | 339/95 D |
| 470778 | 3/1969 | Switzerland | 339/95 D |

*Primary Examiner*—Joseph H. McGlynn

*Attorney, Agent, or Firm*—Workman, Nydegger & Jenson

[57] ABSTRACT

A novel device and method for making an electrical connection to an insulated wire conductor. The device comprises a conductive tube which has a plurality of spring teeth connected thereto and disposed therein so as to virtually block the tube entirely when the teeth are undeflected. Thus, for example, the spring teeth may be formed in a ring which is then secured inside the tube. In order to further enhance the electrical connection, additional sets of spring teeth may be positioned within the tube along its length in a similar manner. The tube also preferably includes an insulation material covering the exterior surface thereof. Advantageously, a portion of the insulation material adjacent each open end of the tube may be formed into a roll which can be rolled out along the wire conductor after it is inserted into the tube, thereby protecting the electrical connection from exposure to moisture and the elements.

8 Claims, 8 Drawing Figures

ELECTRICAL CONNECTOR DEVICES AND METHODS

This is a continuation of application Ser. No. 696,771, filed Jan. 31, 1985, now abandoned.

BACKGROUND

1. The Field of the Invention

This invention relates to electrical connectors and, more particularly, to novel devices and methods for making electrical connections to a wide range of sizes of insulated wire conductors without the need for special tools or equipment.

2. The Prior Art

Whether one is manufacturing or repairing a piece of equipment, or merely making minor adaptations or modifications, there is a great need for devices which are capable of making an electrical connection to an insulated wire conductor. Such connector devices are, for example, commonly found in radios, televisions, and motor vehicles. These connector devices are also quite common in household appliances and on telephone lines.

Traditionally, making an electrical connection to an insulated wire conductor requires several separate steps. First, the insulation material is stripped from the end of the wire conductor to which the electrical connection is to be made. The bare wire conductor end is then secured within some type of connector device. This second step may often first require the partial disassembly of the connector device and/or the use of special tools, such as, for example, a screwdriver or a crimping tool. Finally, the connector device can be appropriately coupled to other electrical components so as to complete the desired electrical circuit.

While the above-described procedure for making an electrical connection does, of course, achieve the intended result, there are a number of significant disadvantages to this traditional procedure. First, in order to make the electrical connection, it is necessary to have on hand a number of specialized tools, such as, for example, a wire stripper for stripping the insulation from the end of the wire conductor, a screw driver for disassembling the connector device, and/or a crimping tool for securing the wire conductor within the connector device. Moreover, it may be necessary to have still additional tools to thereafter couple the connector device to other electrical components so as to properly complete the desired electrical circuit. It will be appreciated, therefore, that it is not only cumbersome and inconvenient to carry all of the required tools, but it also may require a significant amount of time to complete a relatively simple electrical connection. Of course, all of these factors can significantly increase the cost of manufacture and repair.

In an effort to overcome some of the problems outlined above, a number of connector devices have been developed which require virtually no tools in order to connect them to an insulated wire conductor. Typically, such connector devices include some type of opening or passageway through which the end of an insulated wire conductor is inserted, the passageway having a number of sharp protrusions which are deflected by the wire conductor as it is pushed along the passageway. Once the wire conductor is fully inserted within the passageway, the conductor is then pulled or withdrawn from the passageway slightly. This action causes the sharp protrusions to penetrate the insulation material and make contact with the inner wire conductor, thereby electrically connecting the wire conductor to the connector device.

Although such an electrical connector device is relatively simple to use and overcomes many of the problems associated with the use of more traditional electrical connectors, a number of significant problems and difficulties remain.

First, such connectors are typically adapted to be used with only a relatively narrow range of wire conductor sizes. Thus, while it may, perhaps, not be necessary to carry numerous special tools in order to make an electrical connection, it may, on the other hand, be necessary to have on hand a large number of different sizes of connector devices.

In addition, the tool-less connector devices described above typically make a relatively poor electrical connection with a wire conductor and cannot handle much current. This may, of course, cause the resulting electrical circuit to be faulty and/or undependable in its operation. Even more seriously, the connector device may even begin to melt or burn in some cases, thereby posing a significant safety hazard.

Similarly, the prior art tool-less connectors often make a relatively weak mechanical connection with an insulated wire conductor. This can result in the wire conductor coming loose of the connector device after a relatively short period of operation. such a situation thus necessitates further repairs and may also create a significant safety risk.

Further, the prior art connector devices cannot generally be reused. Hence, if a mistake is made or a simple change or adaption is desired, a new connector device must be used. Also, there is, at present, no way to readily insulate the electrical connection made by the prior art connector devices from exposure to moisture and the elements. Thus, the electrical circuit may short out if exposed to moisture, and it may rapidly deteriorate over a period of time so as to render the electrical circuit nonoperational.

Accordingly, it would be an improvement in the art to provide an electrical connector device and method which does not require the use of special tools and/or equipment and which can be used with a wide range of wire conductor sizes. It would be a further improvement in the art to provide a tool-less connector device which makes both a good electrical and a secure mechanical connection with a wire conductor. It would also be an improvement in the art to provide a tool-less wire connector device which can be readily reused. Further, it would be an improvement in the art to provide a wire connector device and method which provides a means for readily insulating the resulting electrical connection from exposure to moisture and the elements. Such a device and method is disclosed and claimed herein.

BRIEF SUMMARY AND OBJECTS OF THE INVENTION

The present invention is directed to a novel device and method for making an electrical connection to an insulated wire conductor. The device comprises a conductive tube which has a plurality of spring teeth connected thereto and disposed therein so as to virtually block the tube entirely when the teeth are undeflected. Thus, for example, the spring teeth may be formed in a ring which is then secured inside the tube. In order to further enhance the electrical connection, additional sets of spring teeth may be positioned within the tube along its length in a similar manner. The tube also preferably includes an insulation material covering the exterior surface thereof. Advantageously, a portion of the insulation material adjacent each open end of the tube may be formed into a roll which can be rolled out along the wire conductor after it is inserted into the tube, thereby protecting the electrical connection from exposure to moisture and the elements.

In use, an insulated wire conductor is inserted into the open end of the tube and through each set of spring teeth. The wire conductor is then pulled slightly such that the teeth cut through the insulation material of the wire conductor and make contact with the inner conductor. The roll of insulation material adjacent the open end of the tube can then be rolled out along the wired conductor so as to protect the resulting electrical connection from exposure to moisture and the elements. Finally, the connector device can be coupled to the appropriate electrical components so as to complete the desired electrical circuit.

It is, therefore, a primary object of the present invention to provide an electrical connector device and method which does not require the use of special tools and/or equipment and which can be used with a wide range of wire conductor sizes.

It is also an object of the present invention to provide a tool-less connector device which makes a good electrical and secure mechanical connection with a wire conductor.

Additionally, it is an object of the present invention to provide a tool-less connector device which is capable of handling relatively large currents.

Further, it is an object of the present invention to provide a tool-less wire connector which can be readily reused.

It is a still further object of the present invention to provide a wire connector device and method which provides a means for readily insulating the resulting electrical connection from exposure to moisture and the elements.

These and other objects and features of the present invention will become more fully apparent from the following description and appended claims, taken in conjunction with the accompanying drawings.

DETAILED DESCRIPTION OF THE PREFERRED EMBODIMENTS

The presently preferred embodiments of the invention will be best understood by reference to the drawings, wherein like parts are designated by like numerals throughout. It will be readily appreciated that the components of the present invention, as generally described and illustrated in the figures herein, could be arranged and designed in a wide variety of different configurations. Thus, the following more detailed description of the embodiments of the device and method of the present invention, as represented in FIGS. 1–8, is not intended to limit the scope of the invention, as claimed, but it is merely representative of the presently preferred embodiments of the invention.

Figure 1:
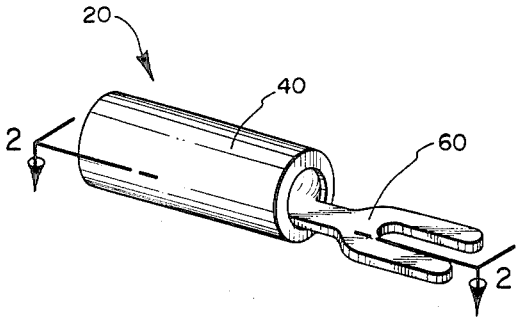
FIG. 1 is a perspective illustration of one presently preferred embodiment of the electrical connector device of the present invention.
Figure 2:
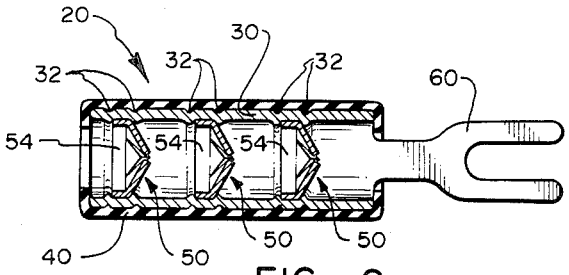
FIG. 2 is a cross-sectional view taken along lines 2—2 of FIG. 1.
Figure 3:
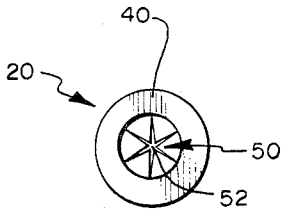
FIG. 3 is an end view of the embodiment of FIG. 1 showing one presently preferred configuration for the spring teeth of the device.

Referring now to FIGS. 1–3, one presently preferred embodiment of the electrical connector device of the present invention, generally designated as 20, is illustrated. As shown, connector device 20 comprises a conductive tube 30. Tube 30 may be formed from any of a number of suitable conductive materials, such as, for example, copper, aluminum, or steel.

Although tube 30 is illustrated herein as being generally cylindrical in shape, tube 30 may have any suitable shape. For example, tube 30 could be formed so as to be triangular, rectangular, or otherwise polygonal in cross-section. Also, the size of tube 30 is not critical, and tube 30 may be virtually any size which is suitable for the particular application and/or for the size range of wires being used.

As shown best in FIGS. 1 and 2, tube 30 is preferably surrounded by an insulation material 40. Insulation 40 may, for example, comprise rubber or plastic which is extruded or molded onto tube 30. Alternatively, insulation 40 may comprises a layer of insulative material which is sprayed onto tube 30.

Attached to one end of tube 30 is some type of electrical coupler. The particular type of electrical coupler which is used will, of course, depend upon the use to which connector 20 is being put. For example, the electrical coupler could be a fork coupler 60 as shown. Alternatively, the electrical coupler could comprise a pin, socket, or other suitable coupling means.

Disposed within tube 30 and in electrical contact therewith are one or more sets of spring teeth 50. Although one set of spring teeth 50 would be generally adequate, additional sets of spring teeth 50 significantly improve the mechanical and electrical connection, as will become more readily apparent from the discussion which follows. Thus, for example, tube 30 may be provided with three sets of spring teeth 50, as shown herein.

For reasons which will be described in more detail below, each set of spring teeth 50 is preferably configured so as to virtually occlude tube 30 when spring teeth 50 are undeflected, as shown in FIG. 3. Moreover, each set of spring teeth 50 define a central opening 52 through which an insulated wire may pass, as set forth more fully below.

Spring teeth 50 are illustrated herein as being substantially triangular in shape. However, spring teeth 50 may have any suitable shape, such as, for example, rectangular, arcuate, or wedge-shaped. Similarly, spring teeth 50 may be formed of any of a number of suitable resilient materials, such as spring steel or copper.

Tube 50 may be provided with spring teeth 50 in a number of ways. For example, spring teeth 50 may be punched out of tube 30 or may be rigidly secured by other suitable means, such as soldering or welding, to the interior of tube 30. Alternatively, as depicted in FIG. 2, spring teeth 50 may be formed as part of a ring 54 which is held in place within tube 30 by appropriately spaced ribs 32.

Figure 4:
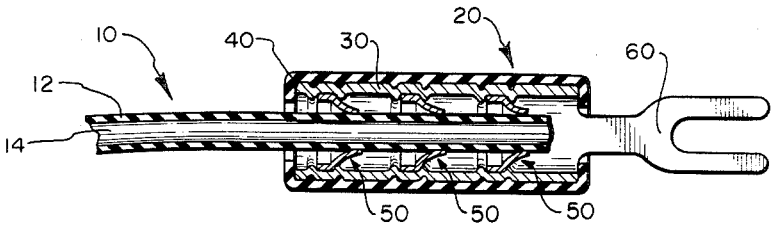
FIG. 4 is a cross-sectional view similar to FIG. 2 wherein an insulated wire conductor has been inserted through each of the sets of spring teeth of the device.
Figure 5:
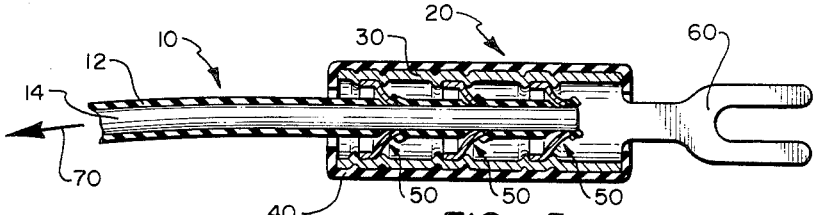
FIG. 5 is a cross-sectional view similar to FIG. 4 wherein the insulated wire conductor has been withdrawn slightly after insertion such that the spring teeth have penetrated the insulation and made mechanical and electrical contact with the inner conductor.

As illustrated in FIG. 4, connector 20 is used by inserting an insulated wire 10 into the open end of tube 30 and through each set of spring teeth 50. As shown, spring teeth 50 will be deflected by wire 10 as wire 10 is pushed along the length of tube 30. Once wire 10 has been fully inserted within tube 30, wire 10 is pulled so as to withdraw wire 10 slightly from tube 30. As depicted in FIG. 5, this results in spring teeth 50 penetrating the insulation 12 of wire 10 and making mechanical and electrical contact with conductor 14. It will be appreciated that wire 10 is now mechanically secured within tube 30 of connector 20 and that conductor 14 of wire 10 is in electrical contact with fork coupler 60.

It will be readily appreciated that, unlike many prior art devices, connector 20 is not limited to use with a particular size wire. On the contrary, because of the configuration of the spring teeth 50, virtually any size wire 10 may be used as long as the diameter of conductor 14 of wire 10 is at least as large as the opening 52 formed by spring teeth 50. Thus, when using the connector 20 of the present invention, it is not necessary to stock a large number of different size connectors.

In addition, connector 20 of the present invention provides a secure mechanical connection since spring teeth 50 completely surround wire 10. This mechanical connection is further enhanced by the use of multiple sets of spring teeth 50. Using multiple sets of spring teeth 50 also allows connector 20 to be used for relatively high currents, as compared to the currents permitted by prior art devices. Thus, connector 20 can be used in a variety of applications which have heretore been limited solely to the traditional time-consuming electrical connectors.

Figure 6:
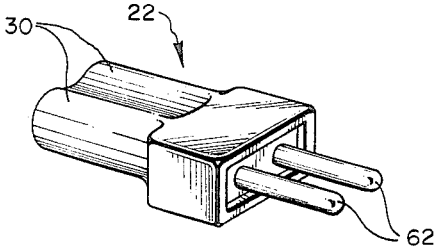
FIG. 6 is a perspective illustration of a second presently preferred embodiment of the electrical connector device of the present invention.

A second preferred embodiment of the connector of the present invention, designated generally as 22, is depicted in FIG. 6. Connector 22 comprises two, adjacent tubes 30 which are each configured as set forth above. In this embodiment, connector 22 is shown with pin couplers 62, although it will be appreciated that any suitable electrical coupler could be used in place of pin couplers 62, as required. In addition, any number of tubes may be positioned adjacent one another to form a multi-wire connector 22 of any desired configuration.

Figure 7:
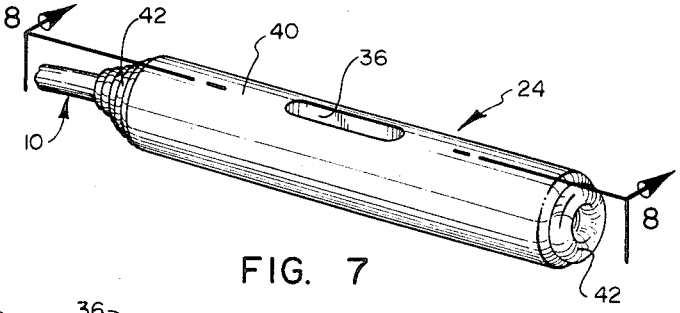
FIG. 7 is a perspective illustration of the third presently preferred embodiment of the electrical connector device of the present invention.
Figure 8:
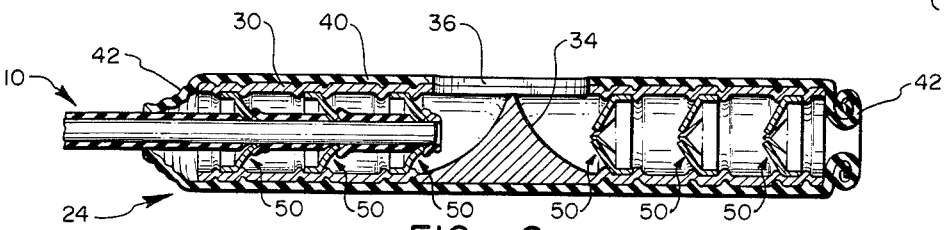
FIG. 8 is a cross-sectional view taken along lines 8—8 of FIG. 7.

A third preferred embodiment of the electrical connector of the present invention, designated generally as 24, is depicted in FIGS. 7 and 8. As shown, connector 24 is configured as a splicer and has two open ends, each of which receives a wire 10. Tube 30 and spring teeth 50 of connector 24 are in all respects identical to those of connectors 20 and 22.

As illustrated, tube 30 of connector 24 may advantageously be provided with a stop or divider 34. Divider 34 prevents a wire 10 from being inserted too far into tube 30 and thereby interfering with a wire 10 entering the other end of tube 30. Divider 34 may also be curved or sloped, as shown, so as to deflect the end of wire 10 out through opening 36, as set forth below. Divider 34 may be formed of any suitable material. Also, divider 34 may be formed integrally with tube 30, as shown, or may be inserted and secured within tube 30 in some other suitable manner.

As illustrated, tube 30 of connector 24 may also be provided with an opening 36 adjacent a central portion thereof which extends through insulation 40. Opening 36 allows a wire 10 to be withdrawn from connector 24, if needed, such that connector 24 can be reused. Thus, a wire 10 can be cut and thereafter pushed through tube 30 until an end is deflected by divider 34 so as to protrude through opening 36. Wire 10 may then be easily grasped and withdrawn from tube 30, and connector 24 can be reused.

Opening 36 can also advantageously be provided with a cap or lid or other sealing means which is impervious to moisture and the elements. Thus, connector 24 may be made reusable without subjecting the interior of connector 24 to unnecessary exposure to moisture or contamination.

Although opening 36 is illustrated herein only in connection with connector 24, it will be readily appreciated that connectors 20 and 22 could be provided with similar openings 36, if desired. In this way, connectors 20 and 22 could also be made reusable.

Connector 24 also includes a roll 42 of insulation material adjacent each open end of tube 30. Once a wire 10 is secured within connector 24, the corresponding roll 42 can be extended along wire 10, thereby protecting the interior of tube 30 from exposure to moisture and the elements. Connectors 20 and 22 could likewise be provided with a roll 42 of insulation material, if desired.

From the foregoing discussion, it will be appreciated that the present invention provides an electrical connector device and method which does not require the use of special tools and/or equipment and which can be used with a wide range of wire conductor sizes. Since the device comprises a plurality of spring teeth and/or sets of spring teeth which engage the conductor simultaneously from virtually all sides thereof, the present invention also provides a tool-less electrical connector device which makes a good electrical and secure mechanical connection with a wire conductor. In addition, the provision of an opening in the side of the connector device allows the wire connector device of the present invention to be readily reused, as needed. Further, the roll of insulation material adjacent the open end of the device provides a means for readily insulating the resulting electrical connection from exposure to moisture and the elements. Thus, it will be appreciated that the present invention provides an electrical connector device and method which is extremely versatile and which overcomes many of the significant problems associated with the prior art.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An electrical connector device, comprising:

a conductive housing having at least one open end; and at least two sets of spring teeth positioned within the housing, said spring teeth in each of said sets being closely arranged in a substantially planar ring so as to substantially occlude the open end of the housing when said spring teeth are undeflected, said spring teeth in each of said sets being positioned within the housing such that an insulated conductor inserted into the open end of the housing deflects each of the spring teeth in each of said sets and passes through said planar ring formed by each of said sets of spring teeth such that the spring teeth of each of said sets surround the insulated conductor and such that the spring teeth of each of said sets penetrate the insulation of the insulated conductor when the insulated conductor is thereafter pulled in a direction out of the housing, thereby securing the insulated conductor within the housing and establishing electrical contact between the conductor and the housing.

2. An electrical connector as defined in claim 1, wherein said housing has an opening formed therein at a position inwardly past said open end of said housing and said planar rings formed by each of said sets of spring teeth, said opening providing an access passageway through which the insulated conductor can be withdrawn, thereby permitting the electrical connector to be reused.

3. An electrical connector as defined in claim 1, wherein three sets of spring teeth are positioned within said housing.

4. An electrical connector as defined in claim 1, further comprising:

an insulation material covering said housing; and means for sealng said insulation material to the insulated conductor, said means for sealing comprising a roll of insulation material capable of being unrolled outwardly to surround and provide a protective covering for said open end of said housing.

5. An electrical connector device, comprising:

a conductor tube having at least one open end; and at least two sets of spring teeth positioned within said tube, said spring teeth in each of said sets being closely arranged in a substantially planar ring and being positioned within said tube such that an insulated conductor inserted into said open end of said tube deflects each of said spring teeth in each of said sets and passes through said planar ring formed by each of said sets of spring teeth such that said spring teeth of each of said sets surround the insulated conductor and such that said spring teeth of each of said sets penetrate the insulation of the insulated conductor when the insulated conductor is thereafter pulled in a direction out of said tube, thereby securing the insulated conductor within said tube and establishing electrical contact between the conductor and said tube.

6. An electrical connector as defined in claim 5, wherein said tube has an opening formed therein at a position inwardly past said open end of said tube and said planar rings formed by each of said sets of spring teeth, said opening providing an access passageway through which the insulated conductor can be withdrawn, thereby permitting the electrical connector to be reused.

7. An electrical connector as defined in claim 6, further comprising:

an insulation material covering said tube; and means for sealing said insulation material to the insulated conductor, said means for sealing comprising a roll of insulation material capable of being unrolled outwardly to surround and provide a protective covering for said open end of said tube.

8. An electrical connector as defined in claim 7, wherein three sets of spring teeth are positioned within said tube.

* * * * *

UNITED STATES PATENT AND TRADEMARK OFFICE

CERTIFICATE OF CORRECTION

PATENT NO. : 4,722,579

DATED : February 2, 1988

INVENTOR(S) : Cummings et al.

It is certified that error appears in the above-identified patent and that said Letters Patent are hereby corrected as shown below:

Cover page, column 1, where inventors are listed, --Melvin C. Cummings, P.O. Box 32, Heber, Utah 84032-- should be added Column 2, line 29, "such a" should be --Such a--

Signed and Sealed this

Second Day of August, 1988

*Attest:*

*Attesting Officer*

DONALD J. QUIGG

*Commissioner of Patents and Trademarks*